United States Patent [19]

Andress, Jr. et al.

[11] Patent Number: 4,652,387

[45] Date of Patent: Mar. 24, 1987

[54] BORATED REACTION PRODUCTS OF SUCCINIC COMPOUNDS AS LUBRICANT DISPERSANTS AND ANTIOXIDANTS

[75] Inventors: Harry J. Andress, Jr., Wenonah; Henry Ashjian, E. Brunswick, both of N.J.

[73] Assignee: Mobil Oil Corporation, New York, N.Y.

[21] Appl. No.: 890,680

[22] Filed: Jul. 30, 1986

[51] Int. Cl.[4] ..... C10M 129/00; C10M 133/44

[52] U.S. Cl. ..... 252/49.6; 252/51.5 A; 252/403; 548/405

[58] Field of Search ..... 252/49.6, 51.5 A, 403; 548/405

[56] References Cited

U.S. PATENT DOCUMENTS

| | | | |
|---|---|---|---|
| 4,097,389 | 6/1978 | Andress, Jr. | 252/49.6 |
| 4,295,983 | 10/1981 | Papay et al. | 252/49.6 |
| 4,428,849 | 1/1984 | Wisotsky | 252/51.5 A |
| 4,455,243 | 6/1984 | Liston | 252/49.6 |

*Primary Examiner*—Jacqueline V. Howard

*Attorney, Agent, or Firm*—Alexander J. McKillop; Michael G. Gilman; Howard M. Flournoy

[57] ABSTRACT

Borated reaction products of alkenyl succinic compounds, aryl amines and aminoalcohols are highly effective dispersant and antioxidant/anticorrosion additives for lubricant compositions.

21 Claims, No Drawings

BORATED REACTION PRODUCTS OF SUCCINIC COMPOUNDS AS LUBRICANT DISPERSANTS AND ANTIOXIDANTS

BACKGROUND OF THE INVENTION

The invention relates to borated nitrogen-containing reaction products and to their use in lubricant compositions. More particularly, the reaction products are made by reacting alkenylsuccinic anhydrides or acids with an aminoalcohol and an aryl amine and thereafter borating.

It is known that in the normal use of organic industrial fluids, such as lubricating oils, transmission fluids, bearing lubricants, power transmitting fluids and the like, the base medium is subjected to oxidizing conditions which may result in the formation of sludge, lacquers, corrosive acids and the like. These products are undesirable in the equipment in which the industrial fluid is used. The oxidation residues or heavy contaminants may interfere with the normal operation of the fluid, increase its viscosity, and even cause severe damage to the parts of the equipment themselves.

In the lubrication of modern engines, particularly, oil compositions must be able to prevent acids, sludge and other solid contaminants from remaining near the moving metal parts. Poor piston travel and excessive engine bearing corrosion may result, unless the oil can prevent the sludge and oxidation products from depositing in the engine. Bearing corrosion is another serious problem in gasoline engines which operate at an oil temperature of about 300° F. or higher.

The most desirable way of decreasing these difficulties is to add to the base organic fluid a detergent or dispersant additive capable of dispersing the solid particles to prevent them from interfering with the normal operation of the equipment, and leaving the metal surfaces relatively clean. Today, with modern equipment operating under increasingly strenuous conditions, it is desirable to develop new detergents (dispersants) which have improved dispersant properties, which are soluble in the fluid medium to which they are added, and which are themselves stable therein and which also impart antioxidation and anticorrosion properties thereto.

U.S. Pat. No. 3,714,045 discloses lubricant compositions containing lubricants and a polyimide produced by reacting (1) a heteropolymer produced by reacting an olefin with maleic anhydride in the presence of a free-radical initiator with (2) a primary arylamine.

U.S. Pat. No. 4,474,670 discloses lubricant compositions containing lubricants and reaction products produced by reacting (1) a hindered phenol, (2) a boron compound and (3) an amine.

SUMMARY OF THE INVENTION

In accordance with the invention, there are provided (1) a product made by (a) reacting a polyalkenylsuccinic compound with (i) a diaryl amine of the formula $$ArNHAr^1$$

wherein Ar and $Ar^1$ are the same or different aromatic or aryl groups, or the substituted member thereof, having 6 to 50 carbon atoms, (ii) an aminoalcohol of the formula $$(HOR)_xN(H)_y$$

where R is an alkylene group having 1 to about 6 carbon atoms, x is 1 to 3 and y is 0 to 2, their sum being 3;

and (2) a lubricant composition comprising a major amount of a lubricant and a minor detergent/dispersant or antioxidation/anticorrosion amount of said product.

The Ar and $Ar^1$ substituents may be an aliphatic group, preferably an alkyl group, containing from 1 to 44 carbon atoms. The aromatic group Ar and $Ar^1$ will preferably contain no more than 14 carbon atoms. Preferred specific amines are diphenylamine, phenylalphanaphthylamine and their alkylated derivatives.

Substituent groups R and $R^1$ may be alkyl or aralkyl, or they may be a chloro group, an alkoxyl group or an acyloxy group. Preferably R and $R^1$ will have 1 to 12 carbon atoms and more preferably both R and $R^1$ will be selected from among t-octyl, t-dodecyl, di-t-dodecyl, t-butyl and di-t-butyl groups, $R^2$ may be, for example, methyl, ethyl, butyl, hexyl, octyl, decyl, dodecyl, pentadecyl, octadecyl or eicosyl group.

The preferred alkanolamine is triethanolamine.

DESCRIPTION OF SPECIFIC EMBODIMENTS

The reactions can, broadly, be carried out over a wide range of temperatures from about 50° C. to about 300° C. in from about 0.5 hour to about 10 hours, depending on temperature and reactivity of the reactants. For specific reactions, the temperatures of reaction can be from about 50° C. to about 250° C., preferably about 100° C. to about 200° C. for the reaction between the alkenylsuccinic compound and the diarylamine. When carrying out the reaction of the alkenylsuccinicdiarylamine product with the alkanolamine, the temperature will generally be from about 100° C. to about 300° C., preferably about 150° C. to about 275° C. Times will run from about 1 hour or less to about 10 hours. The boration can be carried out in any convenient manner or sequence and under any conditions known in the art. The borating agent can be boric acid or a compound of the formula $$(RO)_p(BO_2)_qZrY$$

where R, Y and Z are hydrogen or alkyl groups of from 1 to about 6 carbon atoms, p and r are 0 to 2 and q is 1 to 3.

The useful boronating compounds covered by the above formula include boric acid, metaboric acid, alkyl metaborates, alkyl boroxines, boroxine boroxides, and the like, as well as the alkyl borates. Preferably the boration is carried out in substantially stoichiometric ratios of reactants.

The alkenyl group of the alkenylsuccinic compound, preferably the anhydride or the acid, can have a number average molecular weight of from about 360 to about 1800, i.e., it will have from 30 to 150 carbon atoms. They (the alkenyl groups) may be made by any method known to the art, as by the catalytic oligomerization of an olefin, such as one containing 2 to 10 carbon atoms. Further, the oligomer so produced can be reacted with maleic anhydride by well known methods (as by $BF_3$ catalysis) to give the alkenylsuccinic compound.

While the reaction sequence has been disclosed to be reaction of (1) alkenylsuccinic compound and diarylamine, (2) reaction of product of (1) with an alkanolamine (3) and thereafter boronating, the invention is not limited to that method sequence. For example, the alkanolamine may be reacted with the alkenylsuccinic compound, followed by reaction of the product thus obtained with the diarylamine or the product of (1) may be boronated prior to reacting with the aminoalcohol or the diarylamine. The same times and temperatures mentioned above for reactions involving diarylamine, hindered phenol or alkanolamine will generally apply in such reactions. Furthermore, all reactants can be mixed and reacted in one step, in which case the temperature again can be from about 50° C. to about 300° C. and the time from about 0.5 hour to about 10 hours.

The reactants can be used in the range of about 0.1 to about 1.0 mole of diarylamine per mole of alkenylsuccinic compound and from about 0.1 to 1.2 moles of alkanolamine per mole of alkenylsuccinic compound. The preferred amounts of reactants are 1.0 mole of alkenylsuccinic compound, 1.0 mole of diarylamine and no more than about 0.6–0.75 mole of the alkanolamine.

The products of the invention are used in minor dispersant or anticorrosion amounts with a major proportion of a lubricating oil or grease. In general, this will amount to from about 0.05% to about 15% by weight of the total composition. Furthermore, other additives, such as other detergents, antioxidants, antiwear agents and the like may be present. These can include phenates, sulfonates, succinimides, zinc dithiophosphates, polymers, calcium and magnesium salts and the like.

The lubricants contemplated for use with the products herein disclosed include mineral and synthetic hydrocarbon oils of lubricating viscosity, mixtures of mineral oils and synthetic oils, including mixtures. The synthetic hydrocarbon oils include long-chain alkanes such as cetanes and olefin polymers such as oligomers of hexene, octene, decene, and dodecene, etc. The products of this invention are especially effective in synthetic oils formulated using mixtures of synthetic hydrocarbon olefin oligomers and lesser amounts of hydrocarbyl carboxylic ester fluids. Other synthetic oils, which can be mixed with a mineral or synthetic hydrocarbon oil, include (1) fully esterified ester oils, with no free hydroxyls, such as pentaerythritol esters of monocarboxylic acids having 2 to 20 carbon atoms, timethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

Having described the invention with reference to its broader aspects, the following are offered to specifically illustrate it. It will be understood that the Examples are for illustration only and are not intended to limit the scope of the invention.

EXAMPLE 1

A mixture of 1800 grams (1.0 mol) polybutenyl succinic anhydride and 169 grams (1.0 mol) diphenylamine was stirred for three hours at 160° C. After cooling to 100° C., 112 grams (0.75 mol) triethanolamine was added and the mixture stirred to about 225° C. over a six hour period. After cooling to 75° C., a mixture of 186 grams (3.0 mols) of boric acid and 222 grams (3.0 mols) butylalcohol was added and the temperature raised to about 250° C. over a six hour period. The final product was obtained by blowing with nitrogen and filtering.

EXAMPLE 2

A mixture of 1800 grams (1.0 mol) of polybutenylsuccinic anhydride and 169 grams (1.0 mol) of diphenylamine was stirred for three hours at 160° C. After cooling to 100° C., 112 grams (0.75 mol) of triethanolamine were added and the mixture stirred to 225° C. over a six hour period. After blowing with nitrogen, the final product was obtained by filtration.

EVALUATION OF PRODUCTS

Example 1, a product in accordance with this invention and Example 2, an unborated prior art compound were tested side by side under identical conditions in the C.R.C. L-38 Bearing Corrosion Test.

CRC L-38 ENGINE TEST

The CRC L-38 Test is a single-cylinder gasoline engine test which measures oil oxidation and corrosion. The engine is fitted with copper lead inserts in the connecting rod bearing to permit evaluation of bearing corrosion protection. Operation is at elevated coolant and oil temperatures in order to promote oil oxidation and the formation of oxy-acids that are corrosive to these inserts. Oil performance is judged by the weight loss of the bearing inserts after test completion. The following results were obtained in this test:

TABLE 1

| C.R.C. L-38 Bearing Corrosion Test | | | | |
|---|---|---|---|---|
| | Conc. | Bearing Wt. Loss in Mg. | | |
| Example No. | Wt. % | 40 Hours | 80 Hours | 120 Hours |
| 1 | 4.2% | 5 | 6 | 7 |
| 2 | 4.2% | 219 | — | — |

The base oil composition comprised a blend of synthetic oils containing overbased calcium sulfonate, overbased calcium phenate, normal calcium sulfonate, zinc dithiophosphate and a hindered phenol antioxidant.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A product of reaction made by (a) reacting an alkenylsuccinic compound with an amine of the formula $$ArNHAr^1$$

wherein Ar and $Ar^1$ may be the same or different aromatic groups having from 6 to about 50 carbon atoms followed by (b) reacting the product of (a) with an alkanolamine of the formula $$(HOR^3)_xN(H)_y$$

wherein $R^3$ is an alkylene group having 1 to about 6 carbon atoms, x is 1 to about 3 and y is 0 to about 2, their sum being 3 and (c) thereafter boronating the product of (b) with a compound of the formula $$(RO)_p(BO_2)_qZrY$$

wherein R, Y and Z are hydrogen or alkyl groups of from 1 to about 6 carbon atoms, p and r are 0 to 2 and q is 1 to 3.

2. The product of claim 1 wherein the amine is selected from diphenylamine or phenyl-alpha-naphthylamine.

3. The product of claim 1 wherein Ar and $Ar^1$ may each be independently substituted with a $C_1$ to about a $C_{44}$ aliphatic group.

4. The product of claim 1 wherein the alkanolamine is triethanolamine.

5. The product of claim 1 wherein the succinic compound is selected from an alkenyl succinic acid and the anhydride thereof.

6. The product of claim 1 wherein in the alkenylsuccinic compound the alkenyl portion has from 30 to 150 carbon atoms.

7. The product of claim 1 wherein the alkenylsuccinic compound is polybutenylsuccinic anhydride, the polybutenyl having a number average molecular weight of about 1300, the secondary amine is phenyl-alpha-naphthylamine and the alkanolamine is triethanolamine.

8. The product of claim 1 wherein the alkenylsuccinic compound is polybutenylsuccinic anhydride, the polybutenyl having a number average molecular weight of about 1700, the amine is diphenylamine and the alkanolamine is triethanolamine.

9. A lubricant composition comprising a major proportion of a lubricating oil or grease made therefrom and a minor dispersant and/or antioxidant/anticorrosion amount of from about 0.05 to about 15% by weight of the composition of a product of reaction made by (a) reacting an alkenylsuccinic compound with an amine of the formula $$ArNHAr^1$$

wherein Ar and $Ar^1$ may be the same or different aromatic group having 6 to 50 carbon atoms and Ar and $Ar^1$ may each separately have $C_1$ to $C_{44}$ aliphatic group substituted thereof, the reaction being carried out at from about 50° C. to about 250° C. using from about 0.1 to about 1.0 mole of said amine per mole of acid or anhydride, followed by (b) reacting the product of (a) with a compound selected from the group consisting of an alkanolamine of the formula $$(HOR^3)_xN(H)_y$$

wherein $R^3$ is an alkylene group having 1 to 6 carbon atoms, x is 1 to 3 and y is 0 to 2, their sum being 3, and thereafter boronating the resultant product with a compound of the formula $$(RO)_p(BO_2)_qZrY$$

wherein R, Y and Z are hydrogen or alkyl groups of from 1 to about 6 carbon atoms, p and r are 0 to 2 and q is 1 to 3, the reaction in (b) being carried out at from about 100° C. to about 300° C. using from about 0.1 mole to about 1.2 mole of amine reactant per mole of acid or anhydride used in (a).

10. The composition of claim 9 wherein the amine is diphenylamine or phenyl-alpha-naphthylamine.

11. The composition of claim 9 wherein the aliphatic group is an alkyl group.

12. The composition of claim 9 wherein the alkanolamine is triethanolamine.

13. The composition of claim 9 wherein in the alkenylsuccinic compound the alkenyl portion has from 30 to 150 carbon atoms.

14. The composition of claim 9 wherein the alkenylsuccinic compound is polybutenylsuccinic anhydride, the polybutenyl having a number average molecular weight of about 1300, the amine is phenyl-alpha-naphthylamine and the alkanolamine is triethanolamine.

15. The composition of claim 9 wherein the alkenylsuccinic compound is polybutenylsuccinic anhydride, the polybutenyl having a number average molecular weight of about 1700, the amine is diphenylamine and the alkanolamine is triethanolamine.

16. The composition of claim 9 wherein the alkenylsuccinic compound is polybutenylsuccinic anhydride, the polybutenyl having a number average molecular weight of about 1700, the amine is diphenylamine and the alkanolamine is triethanolamine.

17. The composition of claim 9 wherein the lubricant is a lubricating oil.

18. The composition of claim 17 wherein the lubricating oil is a mineral oil.

19. The composition of claim 17 wherein the lubricating oil is a synthetic oil.

20. The composition of claim 17 wherein the lubricating oil is a mixture of mineral and synthetic oils.

21. The composition of claim 9 wherein the lubricant is a grease.

* * * * *